United States Patent [19]

Seals

[11] 4,310,037

[45] Jan. 12, 1982

[54] APPARATUS FOR MOUNTING VALVE BAGS TO FILLING SPOUTS OF FILLING MACHINES

[76] Inventor: Harold Seals, 100 Haney Dr., Chattanooga, Tenn. 37411

[21] Appl. No.: 131,033

[22] Filed: Mar. 17, 1980

[51] Int. Cl.[3] ..... B65B 1/18; B65B 43/26

[52] U.S. Cl. ..... 141/166; 53/571; 141/68; 141/114; 141/315

[58] Field of Search ..... 53/570, 571; 141/10, 141/68, 114, 165, 166, 173, 175, 313-317

[56] References Cited

U.S. PATENT DOCUMENTS

| | | | |
|---|---|---|---|
| 3,676,977 | 7/1972 | Rothmann et al. | 53/570 X |
| 3,989,073 | 11/1976 | Remmert | 141/315 |
| 4,179,868 | 12/1979 | Raiteri | 141/315 X |

*Primary Examiner*—Frederick R. Schmidt

[57] ABSTRACT

An apparatus for automatically mounting valve bags on filling spouts of either a rotary or stationary type filling machine is disclosed. The apparatus comprises a multiplicity of bag pickup and release means mounted about a rotational axis. A bag storage and feed means is provided for feeding a plurality of bags to the bag pickup and release means, positioned at a bag pickup station adjacent to the generally arcuate path defined by the rotating pickup and release means. The apparatus further comprises a combined gripping and valve opening means for gripping the bag and effecting the opening of the valve of the bag and simultaneously releasing the bag from the pickup and release means. The gripping and valve opening means is further comprized of conveyance and activating means for conveying the gripping and valve opening means, mounting the bag on a spout of a filling machine, ungripping the bag and returning to the bag release station, positioned adjacent to the generally arcuate path of the pickup and release means. The apparatus further comprizes a means to align the gripping and valve opening means with the spouts of either a stationary or rotary type filling machine.

The bag pickup and release means rotates past the bag pickup station, enters the bag's bottom fold, transports the bag to the bag release station, inserts the bag in the gripping and valve opening means, affects release from the pickup and release means, mounts the bag on the spout and repeats the cycle.

12 Claims, 11 Drawing Figures

APPARATUS FOR MOUNTING VALVE BAGS TO FILLING SPOUTS OF FILLING MACHINES

BACKGROUND OF THE INVENTION

1. Field of the Invention

This invention relates to an apparatus for automatically mounting a valve bag to a filling spout of a filling machine.

2. Prior Art

Nowadays, the filling of valve bags with finely grained materials, such as cement, agricultural chemicals, etc. is almost always done with the aid of filling machinery. The machinery generally has several filling spouts to which valve bags are mounted which material is delivered to the bags. See for example: U.S. Pat. No. 3,215,173 to Rutherford describes a rotating bag filling and weighing machine wherein the bags are manually placed on the filling machine; U.S. Pat. No. 3,261,379 to Stockel et al describes a filling machine, wherein the material is fluidized, for packaging dry divided solid material. The apparatus may have a plurality of spaced apart filling spouts; U.S. Pat. No. 3,913,637 to Seals (the inventor of the invention described and claimed herein) describes a rotary bagging or filling machine; U.S. Pat. No. 4,019,546 to Hastrub describes a rotary type filling machine having a means attached thereto for automatically placing the valve bags on the spouts. The apparatus used for mounting the bag on the spouts is particularly designed for the rotary packer described therein.

There are thus, generally, two types of filling machines those that are rotary and those that are stationary in-line filling machines. Hastrup and Seals exemplify the rotary type filling machines. They generally comprise a number of filling spouts from which the bags are suspended by the valves. The spouts are usually uniformly distributed about the circumference of a circle and rotated about a vertical axis. Generally, bags are placed manually on the filling spout by an operator whose only task is to pick up the bags from a bag storage means and to place each one on an empty filling spout as it passes him. All other operations of the filling machine, including filling to a predetermined weight and removal of the bag may be automatic.

The stationary in-line fillers, as exemplified by Stockel et al, generally have a plurality of equally spaced apart filling spouts. The operation is very similar to the rotary filling machines, except that the operation requires the movement of the operator vis-a-vis the rotating of the machine.

The bags which are usually employed with such machines are generally called valve bags. These bags are almost always made of paper of different strength, but could in principle be made for example of plastic, e.g. polyethylene.

A valve bag has a front, sides and a back wall, as well as a bottom and a top. When the bag is stored, the bottom and top portions of the bag are folded over and juxtaposed against the front or back wall. As used herein these are called the top and bottom folds. The top of the valve bag is similar to its bottom, i.e. it is substantially closed on all sides, but in the end portion of the top, near one of the edges of the bag, there is provided a filling aperture which is also called a "valve" or "valve means", from which this type of bag derives its name. In the vicinity of the valve means, the top of the bag is provided with a tab which gives it a double wall configuration through which the filling spout is inserted. When the bag is being filled, the material poured into the bag rises toward the top and eventually pushes the tab located underneath the main top surface upwardly, so that when the bag is removed from the filling spout, it is in a substantially closed, filled up condition.

Even at the present time, most valve bags are mounted on the filling spouts of filling machines by hand. It is obvious that the above described process requires substantial manual labor and is correspondingly expensive. In principle, the repetitive nature of the process of mounting such bag suggests mechanization but apparently the properties of valve bags, whose shapes are not stable, and the properties of filling materials have been such that this process has had to be performed primarily by hand. Additionally, the valve bag must be taken from its storage means and then manipulated in a certain manner prior to being mounted on a filling spout. This manipulation includes, firstly, bending the top of the bag up from its normally parallel storage position in which it is juxtaposed against the front or back wall of the bag, and, subsequently opening the valve by lifting or spreading apart the two top regions of the bag which form the valve.

Additionally, the filling machines used nowadays, both the rotary and stationary in-line machines, generally have such short cycling times, i.e. primarily filling times, that they cannot be fully utilized and exploited by servicing the spouts by hand. This condition is particularly true when a single operator is required to service several filling spouts, which is usually the case. The result is poor exploitation of the capabilities of the filling machine and the irregular delivery of filling bags.

There have been several devices designed to perform the task of automatically mounting valve bags to filling spouts of filling machines. The aforementioned Hastrup attempts to accomplish this, however, Hastrup's apparatus can only be used with a particular type machine. U.S. Pat. No. 3,423,903 to Miller describes an apparatus for placing a valve bag on a spout by manipulation of the bag from a magazine by a series of suction cups mounted on an arm and rotated to a vertical position at which time the bag is passed from the pickup set of suction cups to another set of suction cups located on a tram arm. Controls then actuate a valve opening device after which the opening apparatus is retracted and the bag, held in place by the tram mounted suction cups and valve opening holding device moves the length of the tram to be deposited on a spout of the filling machine. This particular apparatus requires several different movements, each consuming a considerable amount of time, so that the total cycling time is still too high and does not permit optimum exploitation of the potential capacity of modern filling machines. Additionally, the suction cups must be absolutely clean, which is a near impossibility considering that you are filling the valve bags with granular material. Additionally the bags must be uniform and smooth with no creases, which is not generally possible. Additionally, Miller is not adapted for use on a filling machine having a plurality of spouts, i.e., stationary in-line filling machine or a rotary machine. Using Miller with the rotary machine would require a "stop-start" with a slight hesitation built in to position the spout in exact alignment to receive the bag from the bag placing machine. Miller is capable of functioning only with a single spout stationary filling unit.

U.S. Pat. No. 3,989,073 to Remmert describes another apparatus for mounting valve bags to filling spouts of filling machines. This machine, however, has a complicated control mechanism and elaborate scheme of operation not conducive to optimum operation.

OBJECTS AND SUMMARY OF INVENTION

It is an object of this invention to provide an apparatus for automatically mounting valve bags to filling spouts of a filling machine, whether the spout be on a rotary type filling machine or on an in-line stationary filling machine.

It is another object of this invention to provide an apparatus for automatically mounting valve bags to filling spouts of a filling machine which includes a novel bag storage and feed means for continuously feeding bags to the apparatus.

It is still another object of this invention to provide an apparatus for automatically mounting valve bags to filling spouts of a filling machine which includes a novel means for picking up the bags from the bag storage and feed means and releasing them for placement on the filling spout.

It is still another object of this invention to provide an apparatus for automatically mounting valve bags to filling spouts of a filling machine which includes a novel gripping means for gripping the bag and simultaneously opening the valve for placement of the bag on the spout of a filling machine.

It is still another object of this invention to provide an apparatus for automatically mounting valve bags to filling spouts of a filling machine which is designed to dramatically cut the time required for a complete cycle of operation.

These and other objects are attained by this invention which is an apparatus for automatically mounting valve bags to filling spouts of a filling machine. Each of the bags has a top, bottom, sides and a valve means. The apparatus comprises:

(a) at least one bag pickup and release means rotatably mounted about a rotational axis;

(b) a bag storage and feed means for storing and feeding a plurality of bags having the tops and bottoms folded to the sides, the storage and feed means positioned at a bag pickup station adjacent the generally arcuate path defined by the rotating pickup and release means;

(c) a gripping means for gripping the top of the bag and simultaneously (i) releasing it from the pickup and release means, and (ii) opening the valve means, the gripping means including a means for ungripping the bag, the gripping means positioned at a bag release station adjacent the generally arcuate path defined by the rotating pickup and release means;

(d) a conveyance and activating means for (i) conveying the gripping means and the bag toward a filling spout, (ii) mounting the valve means of the bag on the spout, (iii) activating the ungripping means to ungrip the bag, and (iv) returning the gripping means to the bag release station.

The bag pickup and release means sequentially rotates past the bag pickup station to pick up the bag at its bottom and remove the bag from the storage means and then rotates to the bag release station wherein the top of the bag is inserted in the gripping means whereby the bag is released from the pickup and release means. The bag pickup and release means then rotates to the bag pickup station to repeat the sequence.

Preferably, the apparatus includes a plurality, e.g. four, bag pickup and release means mounted equi-angularly about the axis, e.g. 90° apart. Each pickup and release means is, preferably, comprised of an arm radially projecting from the axis and a pickup blade attached to the end of the arm at substantially a right angle. As the pickup blade rotates past the pickup station it picks up a bag by entering the bottom fold of the bag.

The apparatus may have an arcuate member extending from about the pickup station to about the release station. The arcuate member is at a distance above the arcuate path defined by the rotating pickup and release means. This distance is such that it maintains the bottom of the bag in a folded position from the point of pickup, i.e. the pickup station to a point at the release station at which the bag is properly positioned in the gripping means.

The bag storage and feed means may further include an automatic feed means for feeding the bags to the pickup station for pick up by the pickup and release means. The automatic feed means may include a pushing surface which feeds a single bag to the pickup station each time a pickup and release means rotates past the pickup station. The bag storage and feed means is preferably at an angle of about 15° to 25°, preferably about 20°, up from the horizontal to assist in feeding bags to the pickup station.

The gripping means is comprised of two parallel longitudinal rollers in longitudinal contact with each other. A spring member connects the rollers and maintains the rollers in contact with each other. The means for ungripping the bag from the gripping means consists of a means for separating the rollers.

A traversing means is provided for automatically and sequentially conveying the apparatus to a plurality of stations in suitable alignment for mounting the bags on a plurality of spaced apart filling spouts, i.e. stationary in-line filling machine.

The invention will be better understood and further objects and advantages will become more apparent from the ensuing detailed specification taken in conjunction with the drawings.

DETAILED DESCRIPTION OF THE PREFERRED EMBODIMENTS

Figure 1:
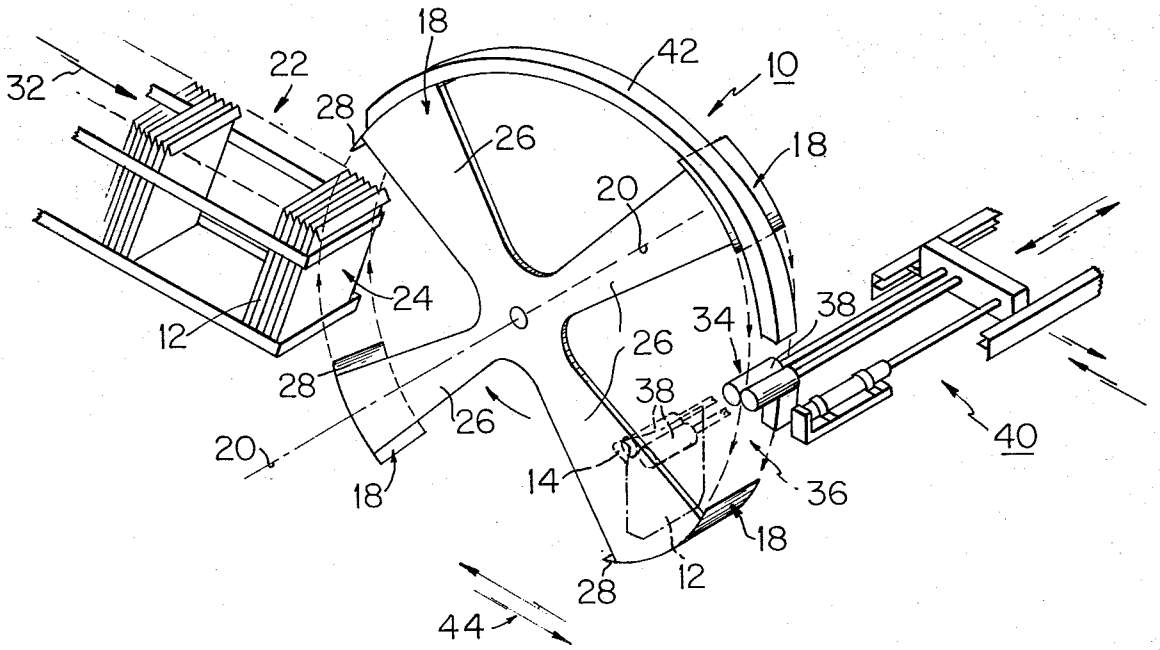
FIG. 1 is a perspective view of an embodiment of the apparatus of this invention for automatically mounting valve bags to filling spouts of a stationary in-line filling machine wherein only the essential elements of the apparatus have been shown for clarity, i.e., the bag pickup and release means, the bag storage and feed means, the gripping means, and the conveyance and activating means as well as the direction of motion of these elements.
Figure 2:
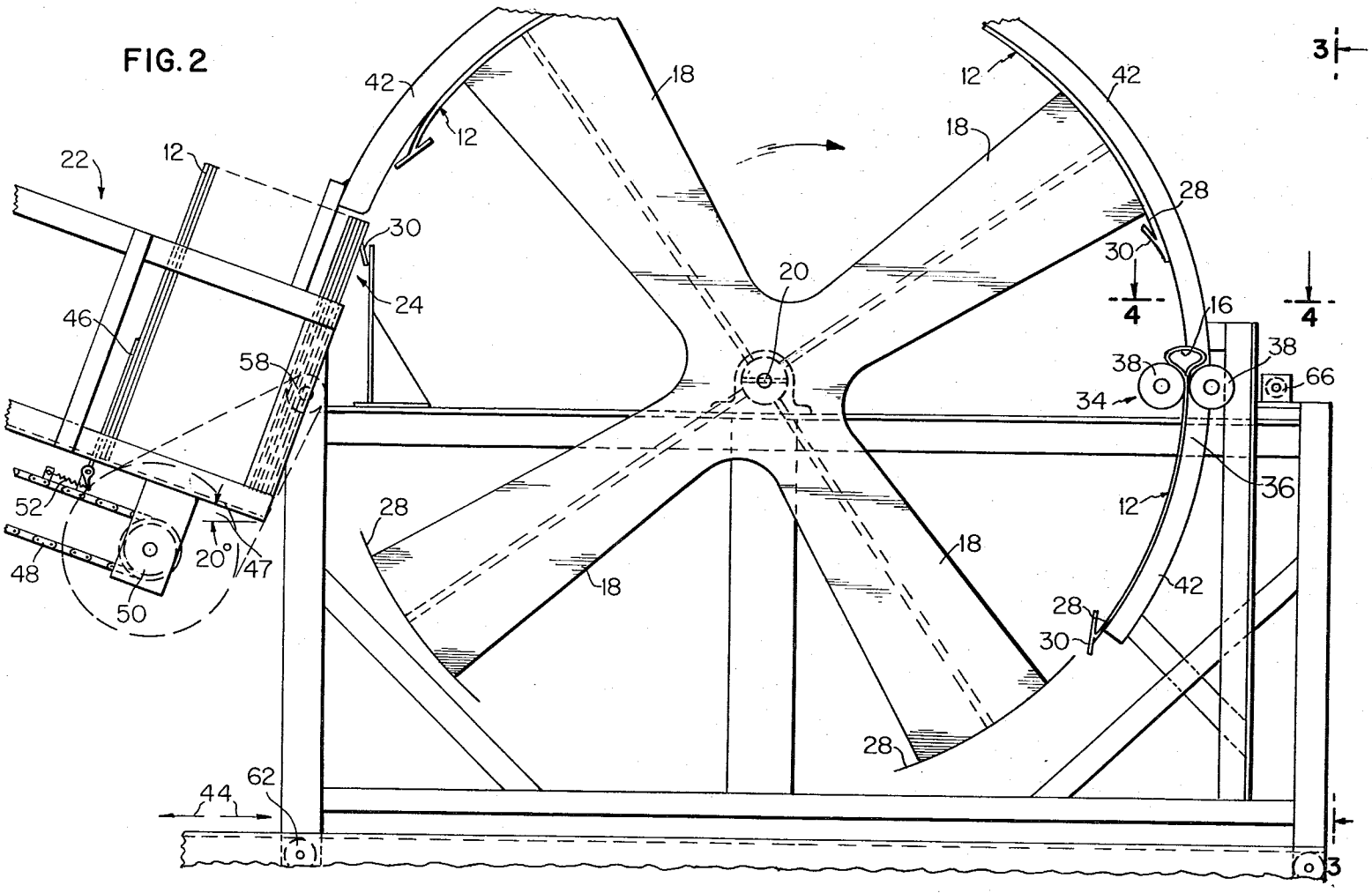
FIG. 2 is a side elevation of an embodiment of the apparatus of this invention for use in conjunction with a stationary in-line filling machine.

Referring to FIGS. 1 and 2, the apparatus of this invention, generally designated (10), is used for automatically mounting valve bags (12) to the filling spouts (14) of a filling machine (not shown).

Valve bags (12) are well known in the art and need not be described in detail herein, but generally they have a top, bottom, side and a valve means (16). The valve means (16) is more clearly depicted in its open position in FIG. 2 and FIG. 9.

The embodiments of the apparatus of this invention (10) as depicted herein include four bag pickup and release means (18) rotatably mounted about a rotational axis (20). In the embodiments depicted herein the four bag pickup and release means (18) rotate clockwise, as indicated by the arrows. It is contemplated that rotation may be counterclockwise provided certain elements, e.g. the bag storage means (22) gripping means (34), etc. are 180° from their present position.

Referring still to FIGS. 1 and 2, the apparatus (10) has as an essential element thereof a bag storage and feed means, generally designated (22). The bag storage and feed means (22) stores and feeds a plurality of bags (12) to the bag pickup and release means (18). The bags (12), as depicted in FIG. 1 and perhaps more clearly in FIGS. 2, 5 and 9, have the tops and bottoms folded to the sides. The storage and feed means (22) is positioned at a bag pickup station, generally designated (24) adjacent the generally arcuate path defined by the rotating pickup and release means (18).

Referring to FIGS. 1 and 2, each pickup and release means (18) is comprised of an arm (26) which radially projects from the rotational axis (20). Attached to the end of the arm (26) at substantially a right angle is a pickup blade (28). In operation, as the bag pickup and release means (18) rotates, the bag pickup blade (28) passes the pickup station (24) and picks up or lifts, from its stored position a bag (12) by entering the bottom fold of the bag, generally designated (30), and continues to rotate, thereby removing the bag (12) from the storage and feed means (22).

The bag storage and feed means (22) includes an automatic feed means, generally designated by arrows (32) in FIG. 1, which feeds the bags (12) to the pickup station (24) for pickup. Preferably, the feed means (32) includes a pushing surface which feeds a single bag (12) to the pickup station (24) each time a pickup and release means (18) rotates past the pickup station (24). A specific embodiment of an automatic feed means (32) and such a pushing surface will be described more in detail below.

Still referring to FIGS. 1 and 2, a gripping means, generally designated (38) is positioned at a bag release station (36) adjacent to the generally arcuate path defined by the rotating pickup and release means (18). The gripping means (34) grips the top of the bag (12) and simultaneously effects release of the bag (12) from the pickup and release means (18) and opens the valve means (16). The gripping means (34) also includes a means for ungripping the bag (12), to be discussed more in detail below.

Figure 4:
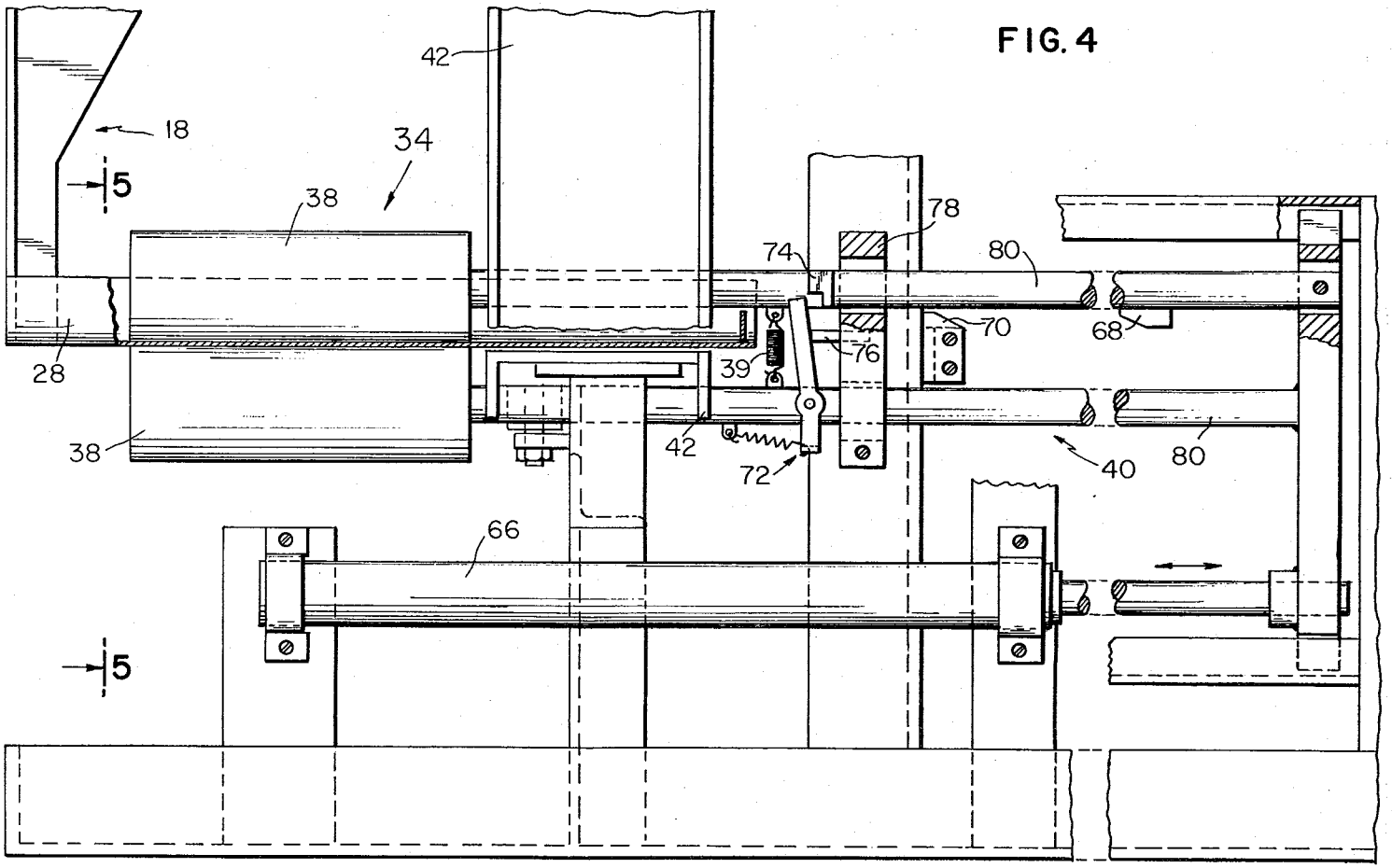
FIG. 4 is a detailed plan view of the gripping means and the conveyance and activating means used in the apparatus of this invention taken along line 4—4 of FIG. 2.

Referring to FIGS. 1 and 2, and particularly FIG. 4, the gripping means (34) is preferably comprised of two parallel longitudinal rollers (38) in longitudinal contact with each other. A spring member (39) connects the rollers (38) and maintains the rollers (38) in longitudinal contact with each other. The gripping means (34) is further provided with a means for separating the rollers (38), to be discussed more in detail below.

Referring to FIG. 1, the apparatus (10) is further provided with a conveyance and activating means, generally designated (40). The means (40) conveys the gripping means (34) and the bag (12) toward a filling spout (14), mounts the valve means (16) of the bag (12) on the spout (14), activates the ungripping means to ungrip the bag (12) and then returns the gripping means (34) to the bag release station (36).

Referring to FIGS. 1 and 2, the apparatus (10) may further be comprised of an arcuate member (42) which extends from a point at about the pickup station (24) to a point at about the release station (36). The arcuate member (42) is at a distance above the arcuate path defined by the rotating pickup and release means (18). This distance is such that it maintains the bottom fold (30) of the bag (12) in a folded position against the side of the bag. This folded position is maintained from the point in time the bag (12) is picked up at the pickup station (24) to the point in time at the release station (36), at which the bag is properly positioned in the gripping means (34). Thus the arcuate member (42) extends a short distance past the release station (36), i.e., about the length of a bag (12) past station (36).

The apparatus (10) is further comprised of a traversing means, generally designated (44) in FIGS. 1 and 2, which automatically and sequentially conveys the apparatus (10) to a plurality of stations which are in suitable alignment for mounting bags (12) on a plurality spaced apart filling spouts. The traversing means (44) conveys the apparatus (10) in the direction indicated by arrows. The traversing means (44) is only used when mounting bags on the spouts of a stationary in-line filling machine having a plurality of spaced apart filling spouts; for a rotary filling machine, the traversing means (44) is not required in view of the fact that the spouts of a rotary filling machine move to and past the alignment position of the gripping means.

Referring to FIG. 2, the bags (12) are inserted in the bag storage and feed means (22) with the bottom fold (30) at the top and the valve means (16) facing toward the filling spouts (14). The bag storage and feed means (22) includes a plurality of spring loaded pushing rods (46) which feed the bags (12) toward the bag pickup station (24). Preferably, the bag storage and feed means (22) is at an angle (47) of about 20° up from the horizontal to assist in feeding the bags (12) to the pickup station (24). This angle has been found particularly suitable in that it assists the feeding of the bags (12) and additionally positions the bottom fold (30) of the bag (12) at the proper angle for pickup by the pickup blades (28). It is believed that an angle (47) from about 15° to about 25° up from the horizontal can accomplish substantially the same function of assisting the feeding of the bags (12) and positioning the bottom fold (30) at the proper angle.

The spring loaded pushing rods (46) are attached at their bottoms to a sprocket chain (48) which passes around a driven sprocket means (50) which pushes the rods (46) forward to feed the bags (12). A spring (52) is attached to the bottom of each rod (46) to provide tension to the rod (46) to permit it to push the bags (12) forward to the pickup station (24). When the rods (46) reach the end of the storage and feed means (22) they pass around the sprocket means (50) and traverse to the beginning of the storage and feed means (22) to start the cycle over. The distance between rods (46) is, preferably, about 18 inches for use with average size valve bags (12) used in packaging, however any distance between the rods (46) may be utilized which accomplishes the task of feeding the bags (12) to the pickup station (24).

Figure 6:
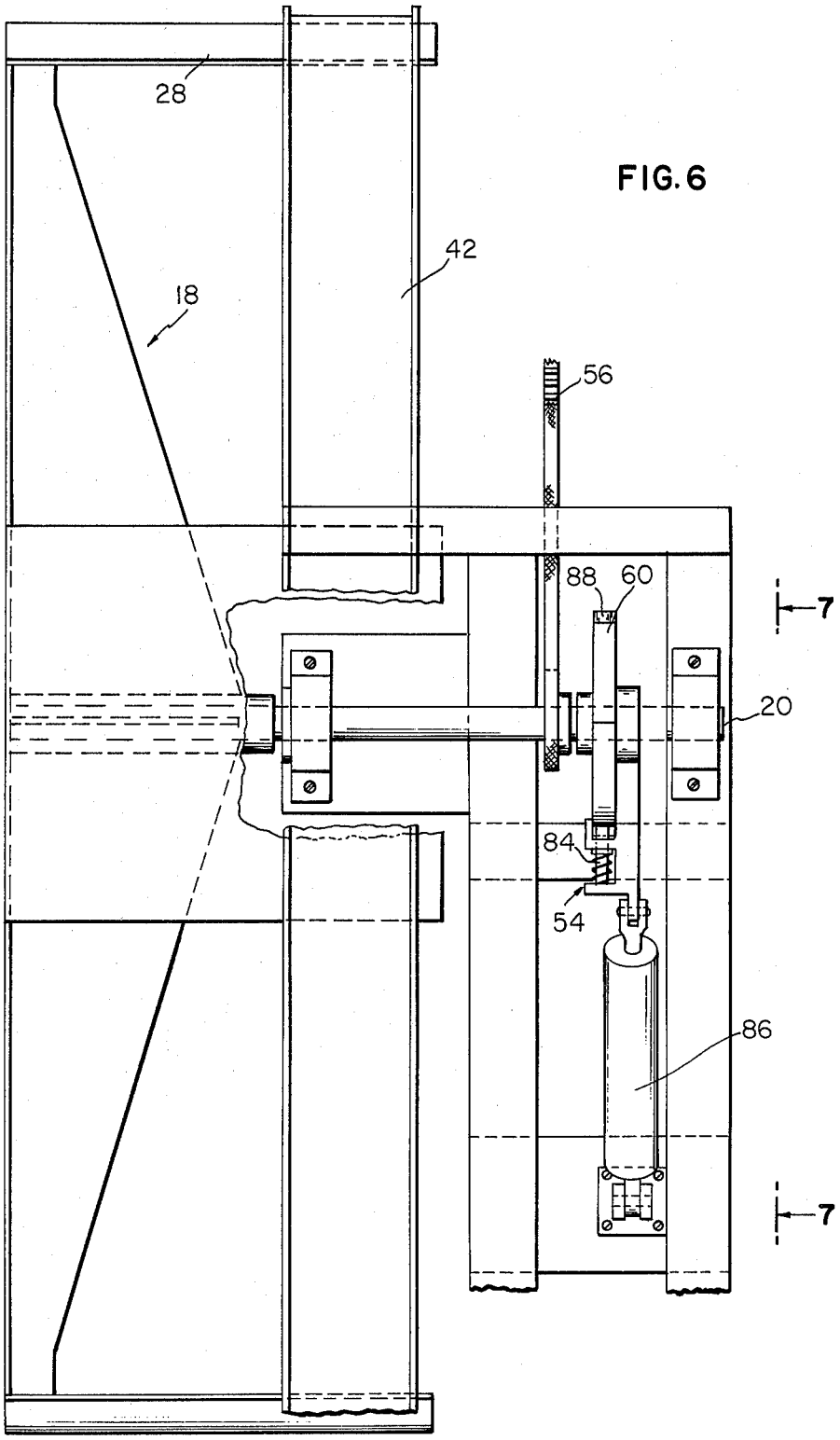
FIG. 6 is a top view detailing the drive means for the bag pickup and release means and bag storage and feed means.

Referring to FIGS. 2 and 6, the driven sprocket means (50) shown in FIG. 2, is driven by a ratchet means, generally designated (54) in FIG. 6, which drives chain (56) and second sprocket means (58) (see FIG. 2) which drives driven sprocket (50). The ratchet means (54) both effects rotation of the bag pickup and release means (18) and drives the sprocket chain (48) to which are attached the pushing rods (46). The ratchet means (54) can be seen more clearly in FIGS. 7 and 7A, discussed below. The chains, sprockets and ratchet means are dimensioned and positioned in such a manner that they simultaneously advance the pushing rods (46) the thickness of one bag (12) with each quarter turn of ratchet (60) (See FIG. 7).

Referring to FIG. 2, as the bag pickup and release means (18) rotates, the pickup blade (28) catches the bottom fold (30) to the bag (12) and carries it around toward the gripping means (34). The arcuate member (42) guides the bag in its rotating motion and maintains the bottom fold (30) in the folded position. The pickup blade (28) at the release station (36) passes between the longitudinal rollers (38) of the gripping means (34) and when the top of the bag (12) and valve means (16) are in the proper position (as indicated in FIG. 2) the bottom fold (30) is at the end of the arcuate member (42). As the gripping means (34) grips the valve means (16) the pickup blade (28) continues to rotate, flips fold (30) over and the bag (12) is maintained in the gripping means (34). The bag pickup and release means (18) continues to rotate to the pickup station (24) to pickup another bag (12). It should be noted that, simultaneously, as the bag (12) is being inserted in the gripping means (34) another bag (12) is being picked up at the pickup station (24) and another bag (12) is in transit, about 90° therefrom.

Referring to FIG. 2, the traversing means (44), not shown in detail here, may consist of, for example, a multiple position air cylinder which moves the entire apparatus (10) on rollers (62) from spout to spout, for example, a four spout inline stationary filling machine. It will move in steps equal to the distance between the plurality of spaced apart filling spouts. The apparatus (10) of this invention may be set up so that the traversing means (44) automatically and sequentially conveys the apparatus (10) to a plurality of stations in suitable alignment for mounting the bags (12) on a plurality of spaced apart, preferably equally spaced apart, filling spouts (14). After such traversing, the traversing means (44) effects the return of the apparatus (10) to its original position, i.e., the first spout (14). If, for example, a three position cylinder is utilized it may be set up so that at each quarter turn of the bag pickup and release means (18), the apparatus (10) advances or retreats to the next spout in line. Generally, about 90% of all bagging companies utilize two, three or four spout in-line stationary filling machines.

Typically, the cylinder may be actuated by a limit switch which is closed when the gripping means (34) returns to the bag release station (36) aftermounting the bag (12) on the filling spout (14). At this point the limit switch in effect tells the traversing means (44) that the apparatus (10) is clear of the filling spout (14) and bag (12) mounted on spout (14) and that it may proceed to the next in line spout of the filling machine.

Figure 3:
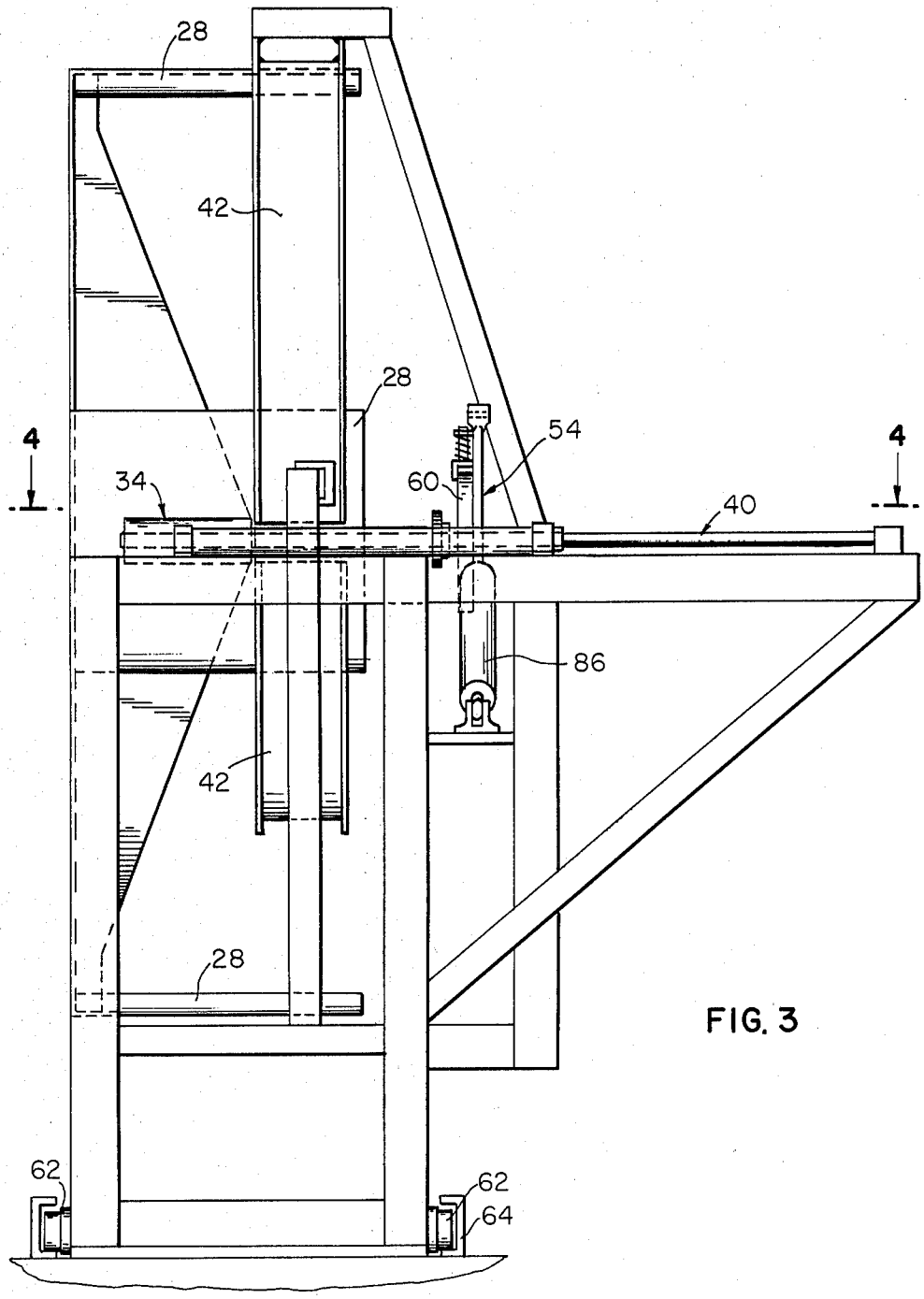
FIG. 3 is a partial side view of the apparatus for this invention taken along line 3—3 of FIG. 2, depicting, inter alia, the bag pickup and release means, the gripping means, and the conveyance and activating means.

FIG. 3 is a partial side view of the apparatus (10) depicting the gripping means (34), the conveyance and activating means (40), the ratchet means (54) and the pickup blade (28) and its relationship to the gripping means (34). Also depicted in FIG. 3 are rollers (62) and guide rail (64) for guiding the rollers (62) along a predetermined track to a plurality of stations which are in suitable alignment for mounting the bags (12) on the plurality of spaced apart filling spouts (14) on a stationary in-line filling machine.

Figure 5:
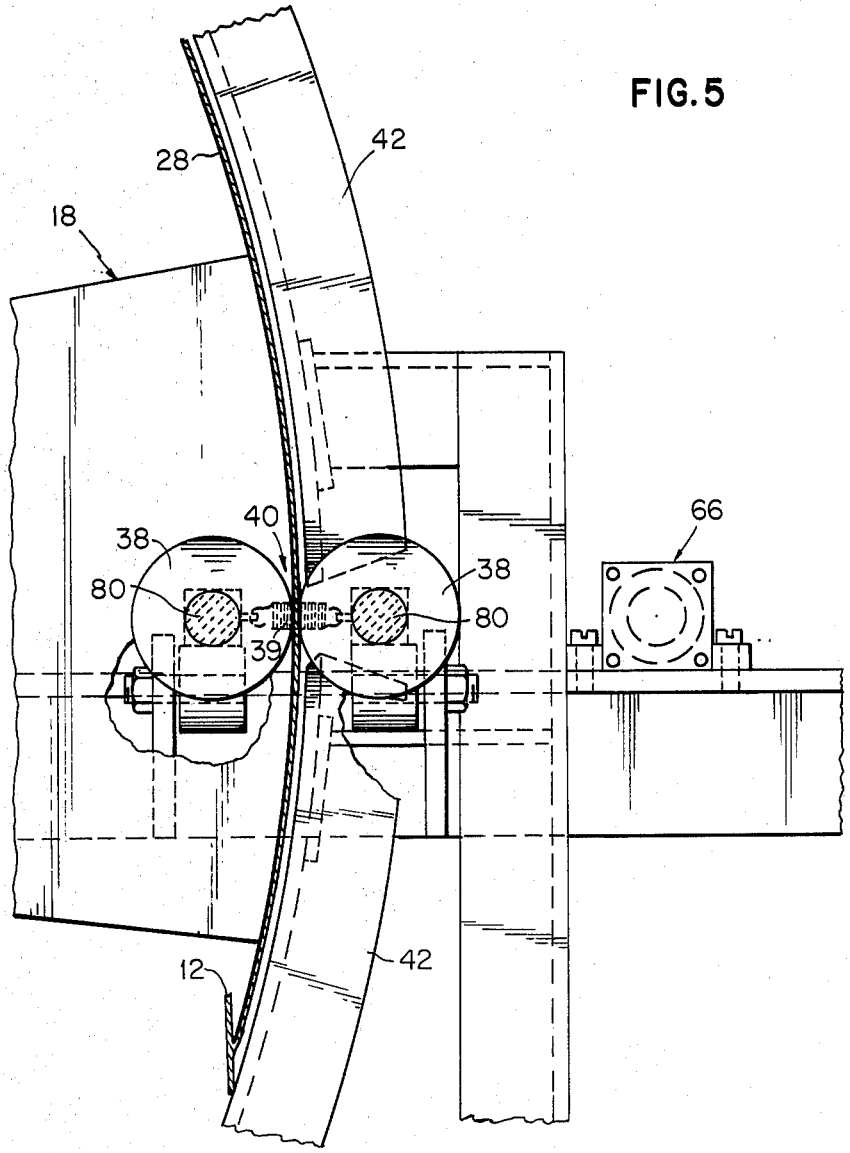
FIG. 5 is an end view of the gripping means taken along line 5—5 of FIG. 4, including the positioning of the bag in the gripping means and the arcuate member utilized to maintain the bottom of the bag in a folded position.

FIGS. 4 and 5 depict the gripping means (34) and the conveyance and activating means (40) in detail. The gripping means (34) consists of longitudinal rollers (38). The rollers (38) are in longitudinal contact with each other. A spring member (39) connects the rollers (38) and maintains them in contact with each other. In FIG. 5, the bag (12) is guided between the rollers (38) and along the arcuate member (42).

Still referring to FIGS. 4 and 5, the conveyance and activating means (40) includes an air cylinder (66) which is the prime motive force of the conveyance and activating means (40). Referring to FIG. 4, when the gripping means (34), i.e. the longitudinal rollers (38), are fully extended for mounting the valve means (16) on the filling spout (14), cam member (68) bumps stationary cam member (70) forcing the rollers (38) apart to thereby release the bag (12) from the rollers (38). A spring trip mechanism (72) latches on to step (74) holding the rollers (38) apart until the rollers (38) return to the original bag release station (36). When the rollers (38) return to such position a stationary rod (76) bumps the spring trip mechanism (72) off step (74) and the rollers (38) are pulled by a spring member (39) into longitudinal contact with each other.

By use of the term "longitudinal contact" it is meant that the parallel longitudinal surfaces of each roller (38) are in contact with or almost in contact with each other and provide sufficient gripping tension between the rollers (38) to grip a bag (12) passing therethrough. Preferably, the longitudinal surfaces of the roller (38) are in contact with each other but are pushed a distance apart substantially equivalent to the thickness of a bag (12) therebetween.

Stationary member (78) guides drive rods (80) and supports rod (76) and stationary cam member (70).

Figure 7:
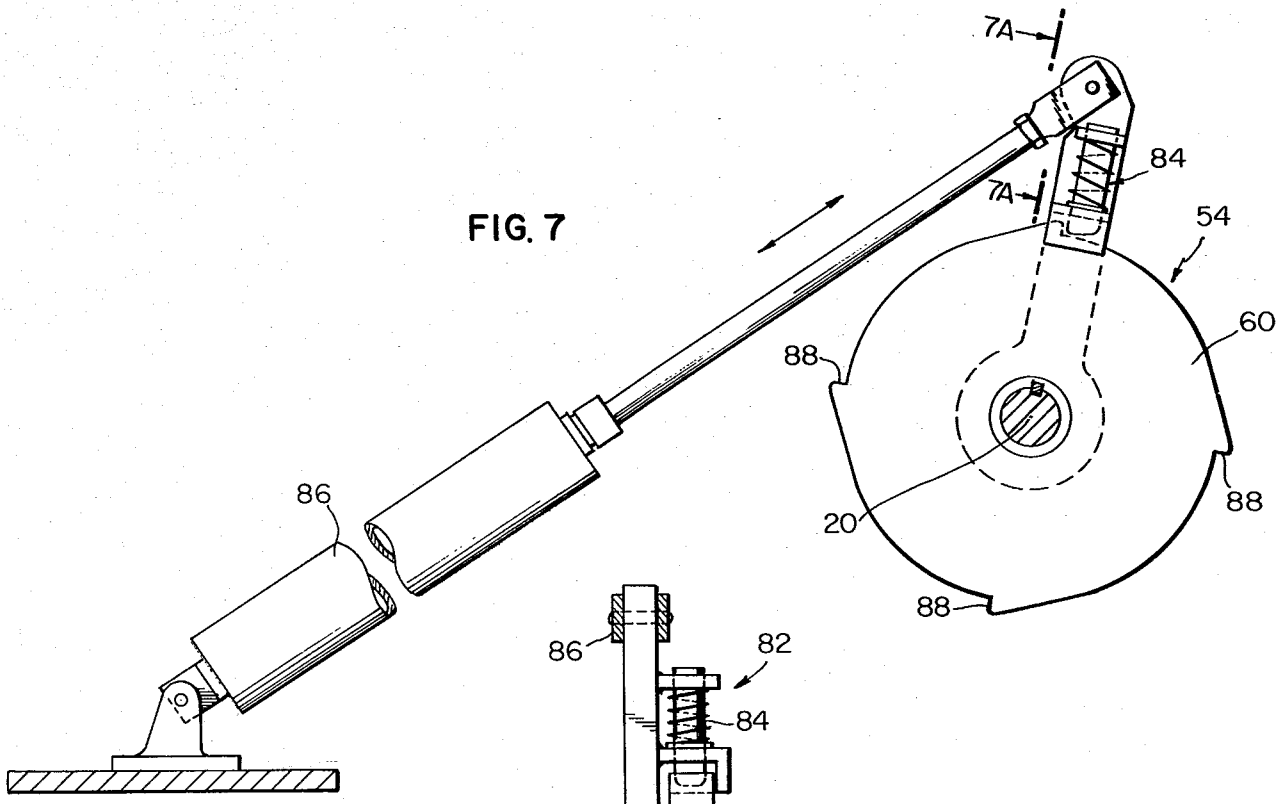
FIG. 7 is a view taken along line 7—7 of FIG. 6 detailing the aforementioned drive means.
Figure 7A:
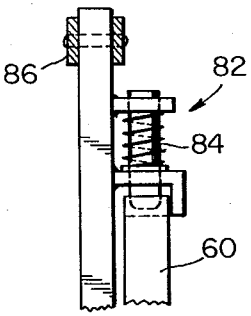
FIG. 7A is a detailed sectional view of a portion of the drive means taken along line 7A—7A of FIG. 7.

FIGS. 6, 7 and 7A are a detail of the ratchet means (54) mounted on rotational axis (20). The ratchet means (54) is comprised of a ratchet (60) attached to the rotational axis (20). Slidably mounted to the circumference of the ratchet (60) is a catch means, generally designated (82), consisting of a spring mounted plunger (84) which rides along the circumference of the ratchet (60). The catch means (82) is driven along the circumference of the ratchet (60) by air piston (86) which periodically extends and retracts. Upon extension of the piston of cylinder (86) the spring mounted plunger (84) catches on lip (88) and upon retraction of the piston (86) the ratchet (60) makes a quarter turn. This periodic motion rotates the bag pickup and release means (18) around the rotational axis (20) and, as previously indicated drives pushing rods (46) through a series of sprockets on chain (48). The sprockets (48) are dimensionally predetermined to move the pushing rods (46) a distance equal to the folded thickness of a bag (12) for each movement of ratchet (60), thus feeding the bags (12) to the pickup station (24).

Figure 8:
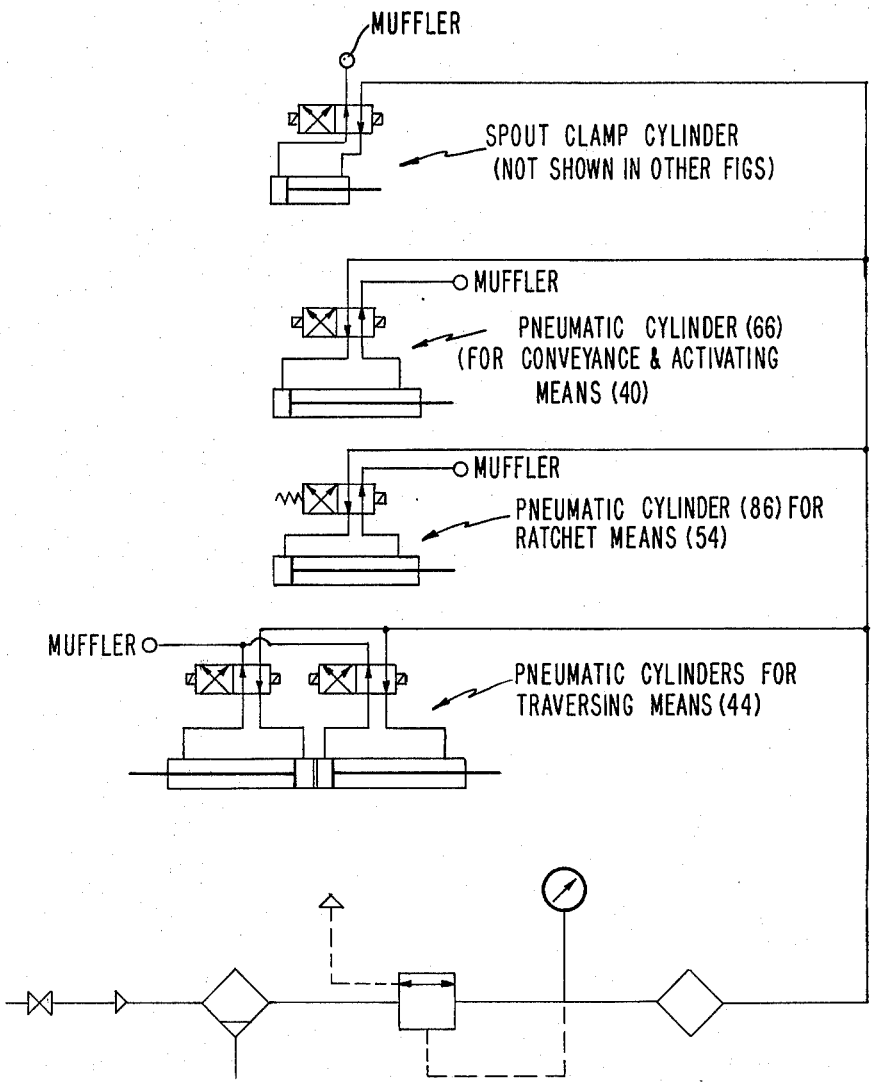
FIG. 8 is a schematic of the pneumatic system which may be used in the apparatus of this invention.

FIG. 8 is a pneumatic schematic of the pneumatic system which may be utilized with the apparatus of this invention. This schematic is self explanatory.

Figure 9:
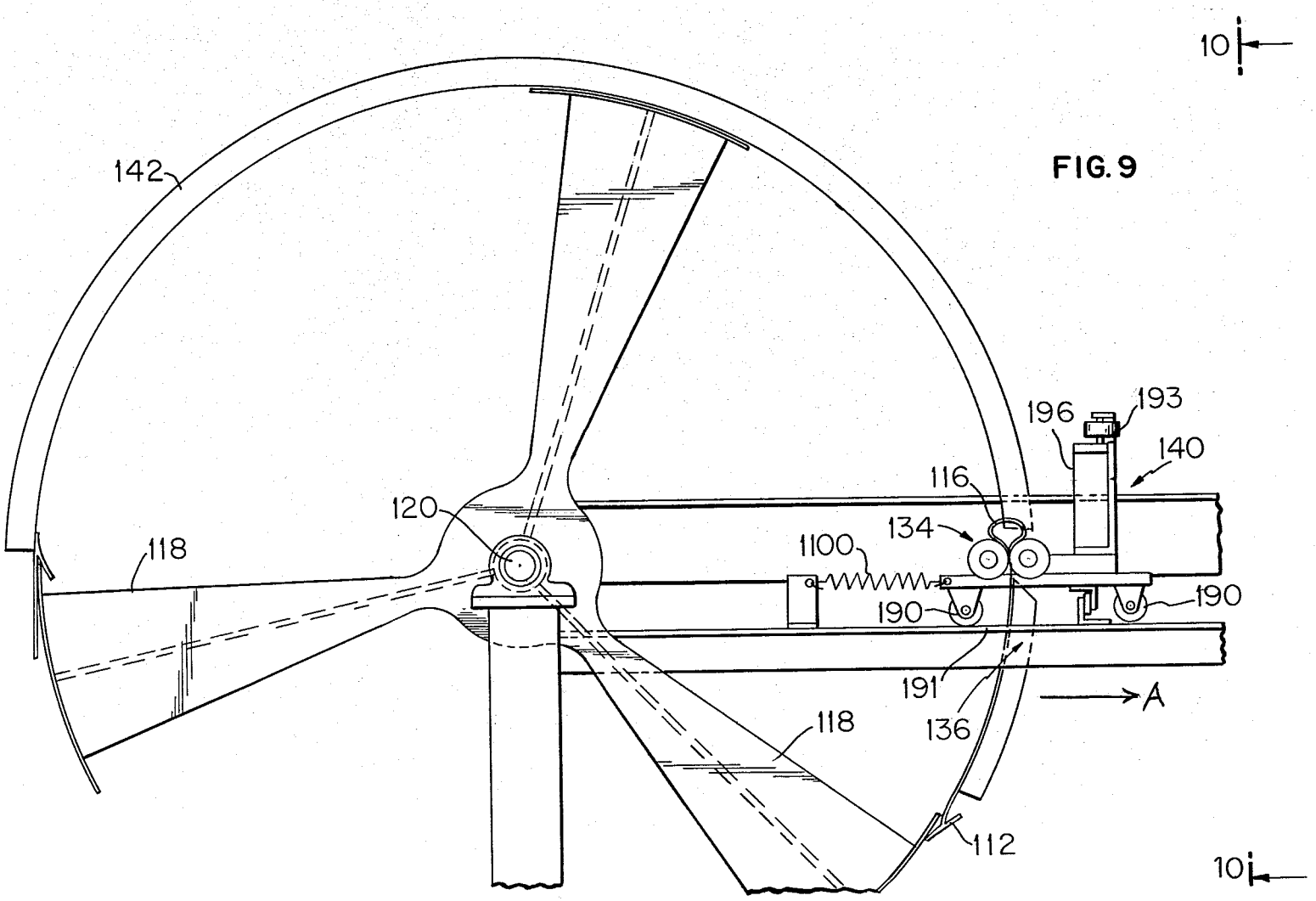
FIG. 9 is a front elevation of an embodiment of the bag pickup and release means and gripping means which may be utilized to mount valve bags on a filling spout of rotary filling machine.
Figure 10:
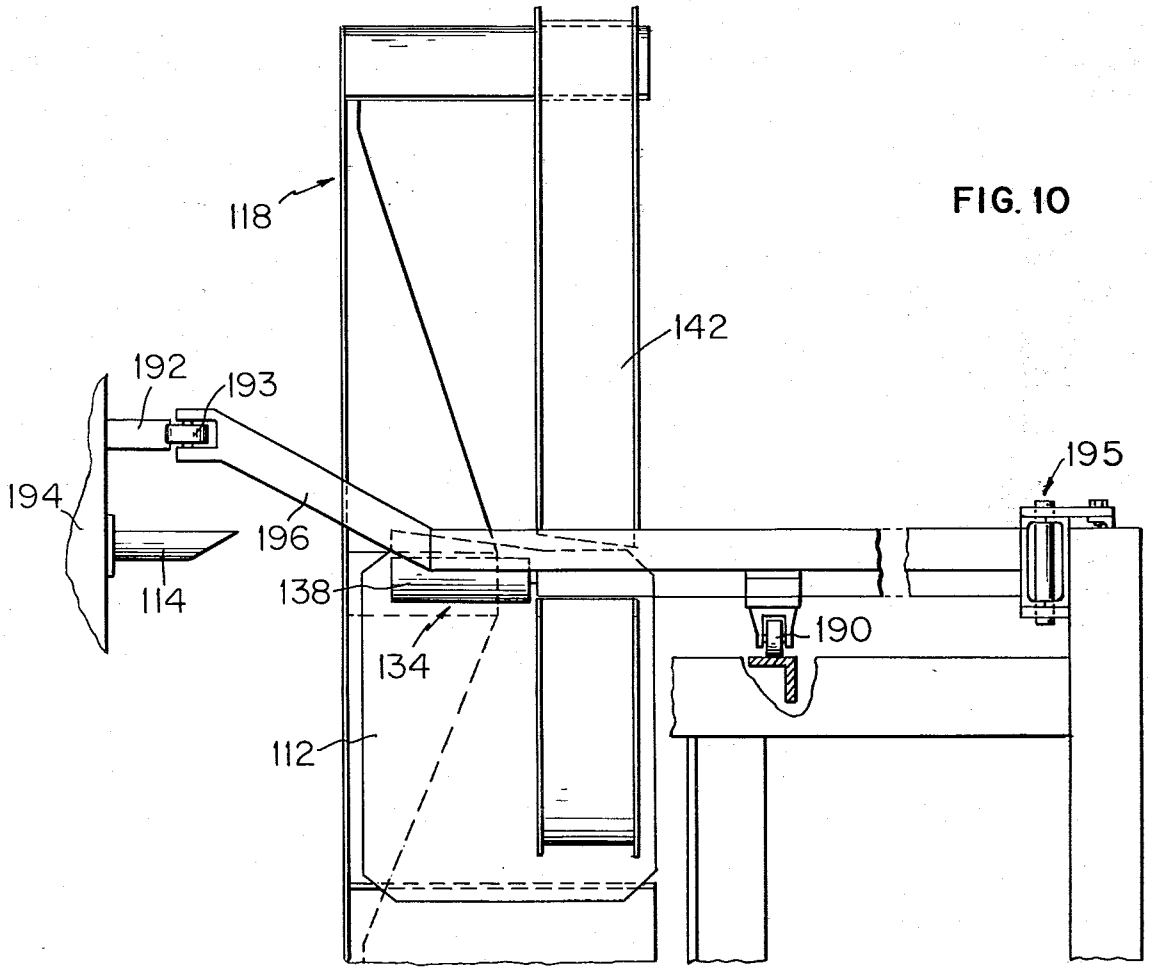
FIG. 10 is a side elevation of the apparatus of FIG. 9 taken along line 10—10 of FIG. 9.

FIG. 9 is a front elevation and FIG. 10 a side elevation of the apparatus of this invention designed to accommodate a rotary type filling machine. All elements of this apparatus are essentially the same. The numbers depicting the elements in FIGS. 9 and 10 are the same as that in FIGS. 1 through 8, except they are preceded by "1". Thus for example the bag pickup and release means, previously numbered (18) is now number (118). It should be noted, however, that the apparatus depicted in FIGS. 9 and 10 may utilize 3 or 4 bag pickup and release means (118). Additionally, since the apparatus is being utilized with a rotary type bag filler, the traversing means (44) and rollers (62) are not required, as with the apparatus used in FIGS. 1 to 8, for the stationary in-line bag filling machine.

In the apparatus depicted in FIGS. 9 and 10 the filling spout (114) on the rotary type filling machine (194) rotates. In order to accommodate this situation the gripping means (134) horizontally traverses with the filling spout (114) on rollers (190) which are on track (191). A cam arm (192) is attached to the filling machine (194) at about the location of each spout (114) on the filling machine (194). Attached to the gripping means (134) is an arm (196) having a roller (193) attached thereto in the manner shown. Thus as the cam arm (192) rotates it catches roller (193) and pushes arm (196) hinged on hinge (195), radially outward (in this case) driving the gripping means (134) and conveyance and activating means (140) attached thereto on rollers (190), radially outward (Arrow A). The conveyance and activating means (140) then conveys the gripping means (134) and the bag (112) toward the filling spout (114), mounts the valve means (116) of the bag (112) on the spout (114) and then activates the ungripping means to ungrip the bag (112). The conveyance and activating means (140) then returns the gripping means (134) to the bag release station (136). Spring (110) then returns the gripping means (134) and the conveyance and activating means (140) to the original bag release station (136).

OPERATION

Referring to FIGS. 1 to 8, in operation, the bags (12) are placed in the bag storage and feed means (22) by an operator or from a continuous conveying means located in position to place the bags in the storage and feed means (22). The bags are placed in the storage and feed means (22) with the bag valve means at the bottom facing the spout (14).

An electrical control start means is actuated to activate the apparatus (10) and simultaneously activate the filling machine. The electrical control start means simultaneously actuates the control valves for the pneumatic cylinder (86) which actuates the ratchet means (54) which rotates the bag pickup and release means (18). The pneumatic cylinders (not shown) for the traversing means (44) automatically and sequentially convey the apparatus (10) to a plurality of stations in suitable alignment for mounting bags (12) on a plurality of spaced apart filling spouts (14).

The rotation of the bag pickup and release means (18) by ratchet means (54) also moves the bags (12) in the bag storage and feed means (22) by the spring loaded pushing rods (46) coupled to the ratchet means (54) by various sprocket and sprocket chain drive means previously described. The spring loaded pushing rods (46) feed the bags (12) through the bag storage and feed means (22) a distance equivalent to one bag thickness for each cycle turn of ratchet (60) which may be a quarter turn of the ratchet means (54). In effect, one bag (12) is fed forward each time the bag pickup and release means (18) passes the bag pickup station (24).

The rotation of the pickup blade (28) of the bag pickup and release means (18) brings the blade (28) in contact with the bottom fold (30) of the bag. The bag (12) is then moved in an upward direction and is removed from the bag storage and feed means (22). The bag is then inserted inside the arcuate member (42) and is in continuous contact with said member while sliding along the surface of the arcuate member (42).

The close proximity of the member (42) to the pickup blade (28) prevents the bottom fold (30) from unfolding and releasing the bag (12) from the pickup blade (28).

The pickup blade (28) then inserts the bag (12) in the gripping means (34). Simultaneously with the movement of the pickup blade (28) the machine traversing means (44) moves the entire apparatus (10) into alignment with the next spout (14) of the stationary in-line filling machine. The rotation of the bag pickup and release means (18) and motion of traversing means (44) is then stopped for a short period of time while the conveyance and activating means (40) operates to place the bag (12) gripped in the gripping means (34) on the spout then automatically releases the bag and retracts to complete its cycle of operation.

During the moment of time while the gripping means (34) is in motion to mount the bag (12) on the spout (14), the bag pickup and release means (18) which will pass the bag release station (36) next, is stationarily holding the bag (12) between the arcuate member (42) and the pickup blade (28). While the bag (12) is in this stationary position a means operative to direct a blast of compressed air (not shown) toward the valve means (16) of the bag is actuated. The force of the air enters the valve means (16) opening it up and positioning the top of the bag and the valve means (16) in a configuration where the top folded surface of the bag (12) is more closely perpendicular to the bag side of the wall thus permitting easier gripping by the gripping means (34).

Upon completion of the conveyance and activating means cycle the next bag pickup and release means (18) moves forward, driven by the ratchet means (54).

The pickup blade (28) guides the bottom fold (30) of the bag (12) between the two longitudinal rollers (38) while the bottom fold (30) continues to be carried circumferentially and is still traversing the arcuate member (42). The side walls of the bag (12) are then being pressed by the longitudinal rollers (38) and the top of the bag at its moment of proper insertion in the gripping means (34) forms a configuration of a "T" with the side walls of the bag. The side walls of the bag near the valve means (16) are then squeezed tight and form the configuration shown in for example FIG. 2, i.e. the valve means essentially forms a parallelogram or diamond shape. The longitudinal rollers (38) are held together by pressure exerted by spring member (39).

At the same instant of time that this configuration is formed, based on the length of the bag, the arcuate member (42) ends. When the arcuate member (42) ends the fold (30) in the bag is permitted to flip over, thus the bag is released from the pickup blade (28) and the bag pickup and release means (18) continues to rotate. The bag (12) is simultaneously gripped securely in the gripping means (34), by longitudinal rollers (38).

The conveyance and activating means then appropriately mounts the bag on a spout as previously described herein.

While the invention has been described with reference to specific embodiments, the description is illustrative and is not to be construed as limiting the scope of the invention. Various modifications and changes may occur to those skilled in the art without departing from the spirit and scope of the invention as defined by appended claims.

What is claimed is:

1. An apparatus for automatically mounting valve bags on filling spouts of either a rotary or stationary type bag filling machine, each bag having a top, bottom, side and a valve means, comprising:

(a) at least one bag pickup and release means rotatably mounted about a rotational axis;

(b) a bag storage and feed means for storing and feeding a plurality of bags having the tops and bottoms folded to the sides, the storage and feed means positioned at a bag pickup station adjacent to the generally arcuate path defined by the rotating pickup and release means;

(c) A bag gripping and valve opening means for gripping the top of the bag and simultaneously (i) releasing it from the pickup and release means, and (ii) opening the valve means, the bag gripping and valve opening means including a means for ungripping the bag, the bag gripping and valve opening means positioned at a bag release station adjacent the generally arcuate path defined by the rotating pickup and release means;

(d) a conveyance and activating means for (i) conveying the bag gripping and valve opening means and the bag toward a filling spout, (ii) mounting the valve means of the bag on the spout, (iii) activating the ungripping means to ungrip the bag, and (iv) returning the bag gripping and valve opening means to the bag release station;

wherein the bag pickup and release means sequentially rotates past the bag pickup station to pickup the bag at its bottom and remove the bag from the storage means and then rotates to the bag release station wherein the top of the bag is inserted in the bag gripping and valve opening means whereby the bag is released from the pickup and release means, and then rotates to the bag pickup station to repeat the sequence.

2. The apparatus of claim 1, wherein the apparatus includes a multiplicity of bag pickup and release means mounted equi-angularly about the axis.

3. The apparatus of claim 2, wherein each pickup and release means is comprised of an arm radially projecting from the axis and pickup blade attached to the end of the arm at substantially a right angle, whereby as the pickup blade passes the pickup station it picks up a bag by entering the bottom fold of the bag.

4. The apparatus of claim 3, further comprising an arcuate member extending from about the pickup station to about the release station and a distance above the arcuate path defined by the rotating pickup and release means which maintains the bottom of the bag in a folded position from the pickup station to a point at the release station at which the bag is properly positioned in the bag gripping and valve opening means.

5. The apparatus of claim 1, wherein the bag storage and feed means includes an automatic feed means motivated by the drive means of the bag pickup and release means for feeding the bags to the pickup station for pickup by the pickup and release means.

6. The apparatus of claim 5, wherein the feed means includes a pushing surface which feeds a single bag to the pickup station each time the pickup and release means rotates past the pickup station.

7. The apparatus of claim 5, wherein the bag storage means is at an angle of about 15° to 25° degrees up from the horizontal.

8. The apparatus of claim 7, wherein the angle is about 20°.

9. The apparatus of claim 1, wherein the bag gripping and valve opening means is comprized of two parallel longitudinal rollers in longitudinal contact with each other; a spring member connecting the rollers and maintaining the rollers in contact with each other; wherein the means for ungripping the bag is a means for separating the rollers after said conveyance and activating means has moved said gripping and valve opening means to place the bag on a filling spout of a bag filling machine.

10. The apparatus of claim 1, further comprising a traversing means for automatically and sequentially conveying the apparatus to a plurality of stations in suitable alignment for mounting bags on a plurality of spaced apart filling spouts.

11. The apparatus of claim 1 or 9 further comprising alignment means to maintain the bag gripping and valve opening means in alignment with the filling spout of a rotary type filling machine while placing a bag on the spout of a rotary type filling machine in a continuous rotating motion.

12. The apparatus of claim 11 wherein the alignment means consists of hinged means, track means, cam and cam arm means, and spring return means to maintain moveable alignment of the bag gripping and valve opening means and the associated conveyance and activating means with a spout of a rotating bag filling machine while the bag gripping and valve opening means and conveyance and activating means function to place a valve bag on the spout of a rotary type bag filling machine, ungrip the bag and said spring return means returns the alignment means to the bag release station.

* * * * *